US005372549A

United States Patent [19]

Piedmont

[11] Patent Number: 5,372,549

[45] Date of Patent: Dec. 13, 1994

[54] WIG FLIPPING DEVICE

[76] Inventor: Gregory H. Piedmont, 13792 Old Highway 80, #44, El Cajon, Calif. 92021

[21] Appl. No.: 986,614

[22] Filed: Dec. 7, 1992

[51] Int. Cl.[5] ..... A63H 33/00

[52] U.S. Cl. ..... 472/54; 446/27

[58] Field of Search ..... 446/26, 27, 308, 309, 446/394, 28, 486, 320, 330, 331; 132/53–55; 2/199; 472/54, 55, 133, 137, 53

[56] References Cited

U.S. PATENT DOCUMENTS

| | | | |
|---|---|---|---|
| 3,098,316 | 7/1963 | McCarthy | 446/27 |
| 3,213,823 | 10/1965 | Levy | 2/199 |
| 3,216,725 | 11/1965 | Hing | 446/27 |
| 3,618,583 | 11/1971 | Pottern | 446/343 |

*Primary Examiner*—Robert A. Hafer
*Assistant Examiner*—Jeffrey D. Carlson

[57] ABSTRACT

A wig flipping device comprising a cap which is connected to a spring-loaded wig is disclosed. A releasable retention mechanism holds the wig to the cap and when a trigger mechanism is activated, the retention mechanism releases causing the spring to uncoil and raise the wig above the cap.

3 Claims, 1 Drawing Sheet

WIG FLIPPING DEVICE

FIELD OF THE INVENTION

The invention relates to a novelty item and more specifically to a wig flipping device.

BACKGROUND AND SUMMARY OF THE INVENTION

There is an old saying "Don't flip your wig." Contrary to this sage advice, the present invention is directed to a device which does flip your wig.

According to one object of the invention, there is provided a device which may be worn on a person's head and includes a spring-loaded wig which upon user activation, can be sprung to surprise and entertain other individuals.

BRIEF DESCRIPTION OF THE DRAWING

The drawing (FIG. 1) depicts an example of a wig flipping device according to one embodiment of the present invention.

DETAILED DESCRIPTION OF THE PREFERRED EMBODIMENT

Figure 1:
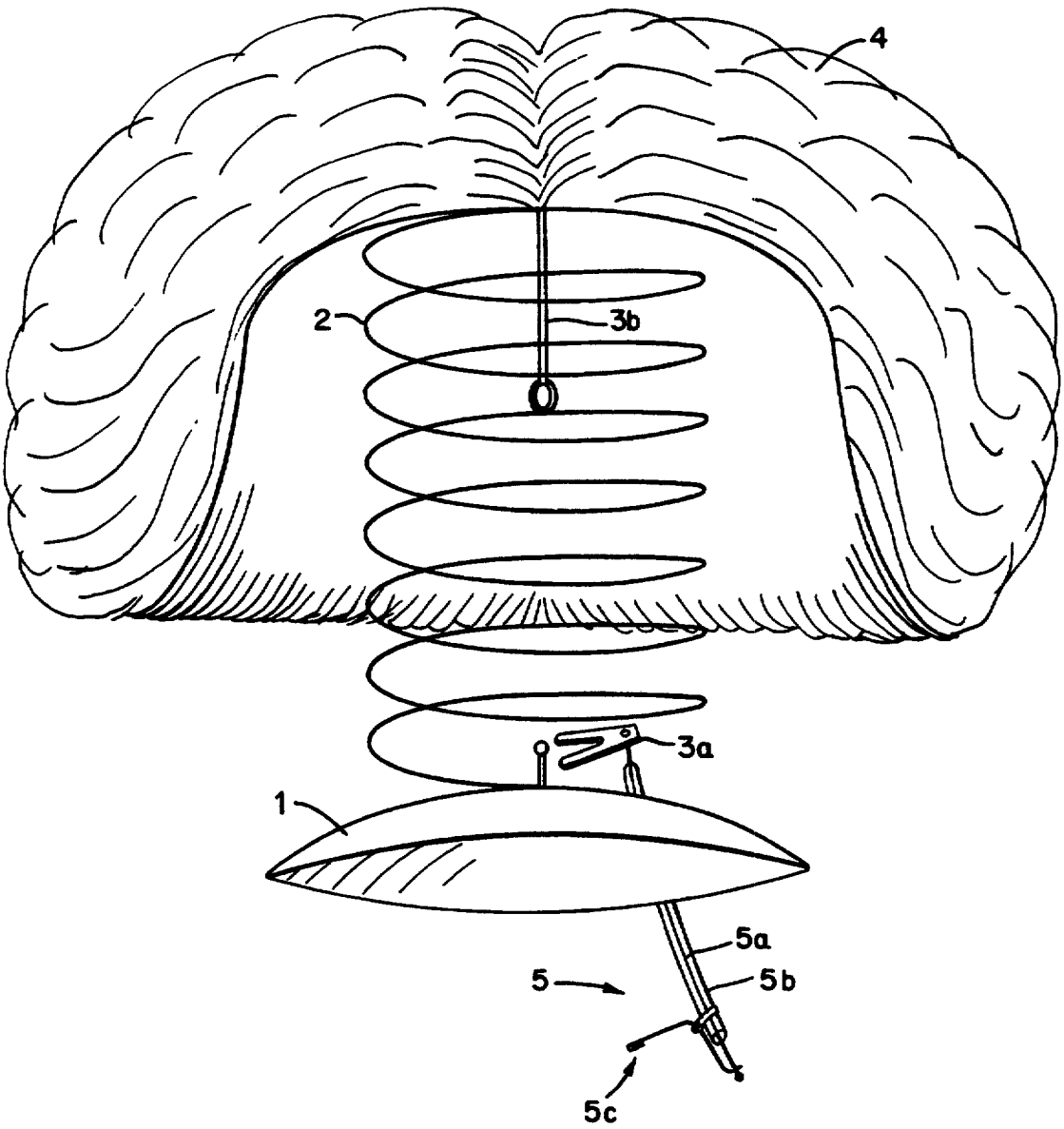

With reference to the Figure, there is shown a wig flipping device according to a preferred embodiment of the present invention. This embodiment includes a cap 1 (or other suitable structure) which is adapted to be worn by a user on the user's head. Caps per se are well known and various alternatives will be readily apparent to one of ordinary skill in the art. According to a preferred embodiment of the invention, preferably the cap 1 is connected to a first end of a spring 2 and has a first portion of a retention mechanism, such as a hook 3*a*, associated therewith. Connected to the other (second) end of the spring 2 is a wig 4. Wigs per se are well known and various alternatives will be readily apparent to one of ordinary skill in the art. Also connected to the wig 4 or the second end of the spring 2 is another (second) portion of the retention mechanism 3*b* which cooperates with the first portion of the retention mechanism 3*a*. The retention mechanism also preferably includes a local or remote trigger release mechanism generally indicated as 5. For example, the trigger release mechanism, if remote, may include a cable or wire 5*a* located within a tube 5*b* where one end of the wire or cable 5*a* is connected to the first portion of the retention mechanism 3*a* and the other end of the wire or cable 5*a* is connected to a trigger mechanism 5*c* which when activated pulls on the wire or cable 5*a* to disengage the first and second portions of the retention mechanism.

In operation, the user compresses the spring 2 and engages the first and second portions of the retention mechanism. In this position, the wig 4 is located in close proximity to the cap 1. The cap 1 is then place on the user's head. Then the trigger mechanism 5*c* and the associated cable or wire 5*a* are preferably positioned so that the trigger mechanism 5*c* is in a position where it can be easily and inconspicuously activated by the user. Upon activation of the trigger mechanism 5*c*, the first and second portions of the retention mechanism are disengaged and the spring 2 uncoils to cause the wig 4 to flip. Preferably, the spring 2 is sufficiently strong to enable it to oscillate for a short period of time and to support the wig above the cap.

Preferably, the first portion of the retention mechanism includes a hook and the second portion includes a loop or other structure to be releasably secured to the hook. Various alternatives will be readily apparent to one of ordinary skill in the art. One or both portions of the retention mechanism may be adjustable to adjust the height of the wig with respect to the cap.

The foregoing is a detailed description of the preferred embodiments of the present invention. Various modifications will be readily apparent to one of ordinary skill in the art. The invention is only limited by the claims appended hereto.

I claim:

1. A wig flipping device comprising;

a cap adapted to be worn on a user's head;

a wig;

a spring having a first end connected to said cap and a second end connected to said wig, said spring having a compressed state and a released state; means to hold said spring in its compressed state, said means capable of releasing said spring to assume its released state, wherein when said spring is in said compressed state, said wig covers at least a portion of said user's head simulating the user's real hair and when said spring is in said released state said wig springs away from said user's head in a surprising manner.

2. The wig flipping device of claim 1 wherein the means to hold said spring further comprises a releasable retention mechanism comprising a first portion associated with said cap and a second portion associated with said wig.

3. The wig flipping device of claim 1 wherein the means to hold said spring further comprises a releasable retention mechanism comprising a first portion associated with said cap and a second portion associated with said wig; the releasable retention mechanism further comprising a trigger mechanism for releasing said retention mechanism.

* * * * *